US009351367B2

(12) United States Patent
Qiao et al.

(10) Patent No.: US 9,351,367 B2
(45) Date of Patent: May 24, 2016

(54) DIMMER COMPATIBLE LIGHT EMITTING DIODE DRIVER

(71) Applicant: KONINKLIJKE PHILIPS N.V., Eindhoven (NL)

(72) Inventors: Haibo Qiao, Shanghai (CN); Dennis Johannes Antonius Claessens, Eindhoven (NL); Hong Jiang, Shanghai (CN); Zhiying Chen, Shanghai (CN); Shitian Tan, Shanghai (CN); Qi Feng Ye, Shanghai (CN)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/651,733

(22) PCT Filed: Dec. 2, 2013

(86) PCT No.: PCT/IB2013/060548

§ 371 (c)(1),
(2) Date: Jun. 12, 2015

(87) PCT Pub. No.: WO2014/091356

PCT Pub. Date: Jun. 19, 2014

(65) Prior Publication Data

US 2015/0341999 A1 Nov. 26, 2015

(30) Foreign Application Priority Data

Dec. 13, 2012 (WO) ..... PCT/CN2012/086588
Mar. 5, 2013 (WO) ..... PCT/CN2013/072190

(51) Int. Cl.

| | |
|---|---|
| ***H05B 37/02*** | (2006.01) |
| ***H05B 39/04*** | (2006.01) |
| ***H05B 41/36*** | (2006.01) |
| ***H05B 33/08*** | (2006.01) |

(52) U.S. Cl.
CPC ..... *H05B 33/0845* (2013.01); *H05B 33/0815* (2013.01)

(58) Field of Classification Search
None
See application file for complete search history.

(56) References Cited

U.S. PATENT DOCUMENTS

| | | | | |
|---|---|---|---|---|
| 7,902,769 | B2 * | 3/2011 | Shteynberg et al. | 315/291 |
| 8,466,631 | B1 * | 6/2013 | Rhodes et al. | 315/291 |
| 2007/0182338 | A1 | 8/2007 | Shteynberg et al. | |
| 2009/0315480 | A1 | 12/2009 | Yan et al. | |
| 2011/0068712 | A1 | 3/2011 | Young | |
| 2011/0285301 | A1 | 11/2011 | Kuang et al. | |

FOREIGN PATENT DOCUMENTS

WO 2010150183 A1 12/2010

OTHER PUBLICATIONS

Slilvestro Fimiani; "Solving the LED-Driver Challenge for Light-Bulb Replacement", Power Integrations, Designing With LEDs, EDN Special Section, Apr. 9, 2009, pp. 1-3.

* cited by examiner

*Primary Examiner* — Anh Tran

(57) ABSTRACT

Drivers (1) for driving lamps (2) comprising light emitting diodes are provided with arrangements (11) for, in response to detections of instantaneous values and average values of input voltage signals, providing output currents. Detected instantaneous values divided by detected average values form ratios. Adaptation circuits (12) for adapting some ratios make the drivers (1) dimmer compatible. The adaptation circuits (12) may comprise first circuits (21-29) for adapting the detected instantaneous values, second circuits (31-38) for adapting the detected average values, and third circuits (91-96) and fourth circuits (101-5) for respectively modulating the detected average and instantaneous values to add bleeder functions. The adaptation circuits (12) may adapt the ratios in different ways during different parts of a period of the input voltage signal and such that a time-interval, during which time-interval an input current signal of the driver (1) has instantaneous values larger than a threshold, is increased.

15 Claims, 5 Drawing Sheets

DIMMER COMPATIBLE LIGHT EMITTING DIODE DRIVER

CROSS-REFERENCE TO PRIOR APPLICATIONS

This application is the U.S. National Phase application under 35 U.S.C. §371 of International Application No. PCT/IB13/060548, filed on Dec. 2, 2013, which claims the benefit of, International Application No PCT/CN2012/086588, filed on Dec. 13, 2012 and International Application No PCT/CN2013/072190, filed on Mar. 5, 2013. These applications are hereby incorporated by reference herein.

FIELD OF THE INVENTION

The invention relates to a driver for driving a lamp comprising one or more light emitting diodes. The invention further relates to a device.

Examples of such a device are lamps and dimmers and parts thereof.

BACKGROUND OF THE INVENTION

US 2011/0285301 A1 discloses a triac dimmer compatible switching mode power supply. Such a switching mode power supply is used for driving a lamp comprising one or more light emitting diodes. This switching mode power supply comprises a power factor correction controller and uses feedback for a primary side regulation and/or a secondary side regulation.

Arrangements having a relatively high power factor and a relatively low total harmonic distortion, while being based on a primary side regulation for saving components and reducing costs, are available on the market, but at least some of these arrangements are not dimmer compatible.

SUMMARY OF THE INVENTION

It is an object of the invention to provide an improved driver. It is a further object of the invention to provide an improved device.

According to a first aspect, a driver is provided for driving a lamp comprising one or more light emitting diodes, the driver comprising

- an arrangement for, in response to detections of instantaneous values of an input voltage signal of the driver and in response to a detection of an average value of the input voltage signal, providing an output current to the lamp, each detected instantaneous value divided by the detected average value forming a ratio, and
- an adaptation circuit for adapting at least some of the ratios to allow the input voltage signal to be provided via a dimmer for dimming the lamp.

The arrangement detects instantaneous values of an input voltage signal of the driver, for example via a first resistor divider, and detects an average value of the input voltage signal, for example via a second resistor divider. In response to these detections, the arrangement provides a relatively constant output current to the lamp.

Each received instantaneous value divided by the received average value is defined to be a ratio. Owing to the fact that several to many instantaneous values will be detected per period of the input voltage signal, there will be several to many ratios. To make the driver dimmer compatible, such as for example triac dimmer compatible, the driver is provided with the adaptation circuit for adapting at least some of the ratios to allow the input voltage signal to be provided via a dimmer for dimming the lamp.

As a result, even arrangements, that themselves are not dimmer compatible, can now be used in dimmer compatible drivers, and this is a great advantage.

The input voltage signal may for example be a rectified sine wave coming from a rectifier coupled to a mains supply via a dimmer, but other kinds of input voltage signals are not to be excluded. The arrangement may be an arrangement in the form of an integrated circuit or may be another kind of arrangement. The arrangement may be an arrangement having a primary side regulation, but other kinds of arrangements are not to be excluded. Usually, the arrangement itself will not be dimmer compatible, without having excluded that the adaptation is going to be used to improve a performance of an arrangement that itself already is dimmer compatible. A lamp comprises one or more light emitting diodes of whatever kind and in whatever combination.

An embodiment of the driver is defined by the adaptation circuit being arranged for adapting the ratios in different ways during different parts of a period of the input voltage signal. When using an arrangement that itself is not dimmer compatible in combination with a dimmer, during different parts of the period of the input voltage signal different measures may need to be introduced for improving a dimmer compatibility of the driver. The adaptation circuit should therefore behave differently during the different parts of the period of the input voltage signal.

An embodiment of the driver is defined by the adaptation circuit being arranged for adapting the ratios such that a time-interval, during which time-interval an input current signal of the driver has instantaneous values larger than a threshold, is increased. At least some dimmers do not like it, when the input current signal of the driver has a relatively low value during a relatively long time interval.

An embodiment of the driver is defined by the adaptation circuit comprising

- a first circuit for adapting the detected instantaneous values of the input voltage signal.

One way to adapt at least some of the ratios is to adapt the corresponding detected instantaneous values of the input voltage signal.

An embodiment of the driver is defined by the first circuit being arranged for adapting the detected instantaneous values of the input voltage signal in different ways during different parts of a period of the input voltage signal. As discussed before, the adaptation circuit should behave differently during the different parts of the period of the input voltage signal.

An embodiment of the driver is defined by the first circuit comprising

- an edge shaper for increasing a steepness of first groups of detected instantaneous values of the input voltage signal around 0 degrees and around 180 degrees of the period of the input voltage signal, and/or
- a delay introducer for introducing a time lag in a second group of detected instantaneous values of the input voltage signal between 1 or more degrees and 179 or fewer degrees of the period of the input voltage signal, and/or
- a top shaper for making a third group of detected instantaneous values of the input voltage signal more sinusoidal around 90 degrees of the period of the input voltage signal.

Three different parts of the period of the input voltage signal can be distinguished: First parts around 0 degrees and around 180 degrees of the period of the input voltage signal, a second part between 1 or more degrees, preferably 10 or more degrees, and 179 or fewer degrees, preferably 170 or fewer degrees, of the period of the input voltage signal, and a third part around 90 degrees of the period of the input voltage signal. During the first parts, the edge shaper increases a steepness of detected instantaneous values of the input voltage signal. During the second part, the delay introducer introduces a time lag in detected instantaneous values of the input voltage signal. During the third part, the top shaper makes detected instantaneous values of the input voltage signal more sinusoidal.

An embodiment of the driver is defined by the edge shaper comprising a first parallel connection of a first diode and a first resistor, the delay introducer comprising a second parallel connection of a first capacitor and a second resistor, the top shaper comprising a third resistor, one side of the first parallel connection being coupled to a first terminal to be coupled to a first reference potential, one side of the second parallel connection being coupled to the other side of the first parallel connection, one side of the third resistor being coupled to the other side of the second parallel connection, one side of a fourth resistor being coupled to the other side of the third resistor and to one side of a fifth resistor, the other side of the fourth resistor being coupled to a second terminal for receiving the input voltage signal, the other side of the fifth resistor being coupled to one side of a third parallel connection of a sixth resistor and a second capacitor and to a first input of the arrangement for providing the adapted detected instantaneous values of the input voltage signal to the arrangement, and the other side of the third parallel connection being coupled to the first terminal.

An embodiment of the driver is defined by the adaptation circuit comprising a second circuit for adapting the detected average value of the input voltage signal.

Another way to adapt at least some of the ratios is to adapt the detected average value of the input voltage signal. Preferably, the detected average value of the input voltage signal is adapted together with the adaptations of the detected instantaneous values of the input voltage signal, but in mutually different ways.

An embodiment of the driver is defined by the second circuit comprising a limiter for limiting a minimum value of the detected average value of the input voltage signal.

An operating dimmer reduces the average value of the input voltage signal. At least some of the arrangements show an improved dimmer compatibility when the minimum value of the detected average value of the input voltage signal is lifted up and/or does not get smaller than a minimum value.

An embodiment of the driver is defined by the limiter comprising a seventh resistor, a second diode and a third diode, one side of the seventh resistor being coupled to a third terminal to be coupled to a second reference potential, one side of the second diode being coupled to the other side of the seventh resistor and to one side of the third diode, the other side of the second diode being coupled to a first terminal to be coupled to a first reference potential, the other side of the third diode being coupled to one side of a third capacitor, to one side of an eighth resistor and to one side of a ninth resistor, the other side of the eighth resistor being coupled to a second terminal for receiving the input voltage signal, the other side of the third capacitor being coupled to the first terminal, the other side of the ninth resistor being coupled to one side of a fourth parallel connection of a tenth resistor and a fourth capacitor and to a second input of the arrangement for providing the adapted detected average value of the input voltage signal to the arrangement, the other side of the fourth parallel connection being coupled to the first terminal.

An embodiment of the driver is defined by the adaptation circuit comprising a third circuit for modulating the detected average value of the input voltage signal.

The third circuit adds a bleeder function to the driver by modulating the detected average value of the input voltage signal.

An embodiment of the driver is defined by the third circuit comprising first and second transistors, one side of an eleventh resistor being coupled to a second terminal for receiving the input voltage signal, the other side of the eleventh resistor being coupled to a control electrode of the first transistor and via a twelfth resistor to a first terminal to be coupled to a first reference potential, a first main electrode of the first transistor being coupled to the first terminal, a second main electrode of the first transistor being coupled to a control electrode of the second transistor and via a thirteenth resistor to a third terminal to be coupled to a second reference potential, a first main electrode of the second transistor being coupled to the first terminal, and a second main electrode of the second transistor being coupled via a fourteenth resistor to a second input of the arrangement for providing the modulated detected average value of the input voltage signal to the arrangement.

An embodiment of the driver is defined by the adaptation circuit comprising a fourth circuit for modulating the detected instantaneous values of the input voltage signal.

The fourth circuit adds a bleeder function to the driver by modulating the detected instantaneous values of the input voltage signal.

An embodiment of the driver is defined by the fourth circuit comprising a third transistor and a fourth diode, one side of a fifteenth resistor being coupled to a second terminal for receiving the input voltage signal, the other side of the fifteenth resistor being coupled to a control electrode of the third transistor and via a sixteenth resistor to a first terminal to be coupled to a first reference potential, a first main electrode of the third transistor being coupled to the first terminal, a second main electrode of the third transistor being coupled to one side of the fourth diode and via a seventeenth resistor to a third terminal to be coupled to a second reference potential, the other side of the fourth diode being coupled to a first input of the arrangement for providing the modulated detected instantaneous values of the input voltage signal to the arrangement.

According to a second aspect, a device is provided comprising the driver as defined above and further comprising the lamp and/or the dimmer.

Available arrangements provide output currents to lamps in response to detections of instantaneous values and average values of input voltage signals. A basic idea is that, for each detected instantaneous value divided by the detected average value forming a ratio, at least some of the ratios are to be adapted to allow the input voltage signal to be provided via a dimmer for dimming the lamp.

A problem to provide an improved driver has been solved. A further advantage is that the driver is based on an available arrangement that is robust and low cost and on an adaptation circuit that is robust and low cost.

These and other aspects of the invention will be apparent from and elucidated with reference to the embodiments described hereinafter.

DETAILED DESCRIPTION OF EMBODIMENTS

Figure 1:
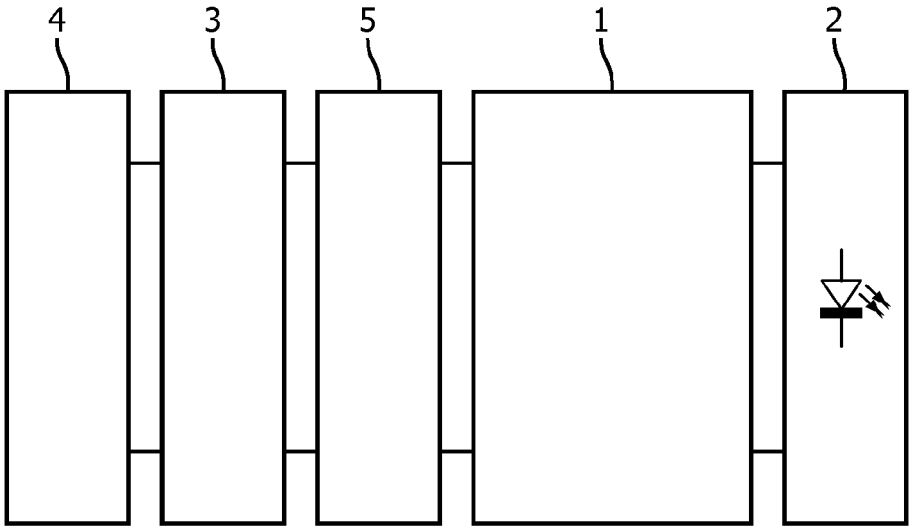
FIG. 1 shows a mains supply, a dimmer, a rectifying interface, a driver and a lamp.

In the FIG. 1, a mains supply 4, a dimmer 3, a rectifying interface 5, a driver 1 and a lamp 2 are shown. The mains supply 4 provides for example a mains voltage signal of 220 Volt at 50 Hz or 110 Volt at 60 Hz, without having excluded other voltages and frequencies. The dimmer 3 is for example a triac dimmer, that in operation during a part of (a half of) a period of the mains voltage signal is conducting and that during another part of (the half of) the period of the mains voltage signal is not conducting, without having excluded other kinds of dimmers. The rectifying interface 5 comprises for example a transformer and a rectifier and one or more filters. An embodiment of the driver 1 is shown in greater detail in the FIG. 2. The lamp 2 comprises one or more light emitting diodes.

Figure 2:
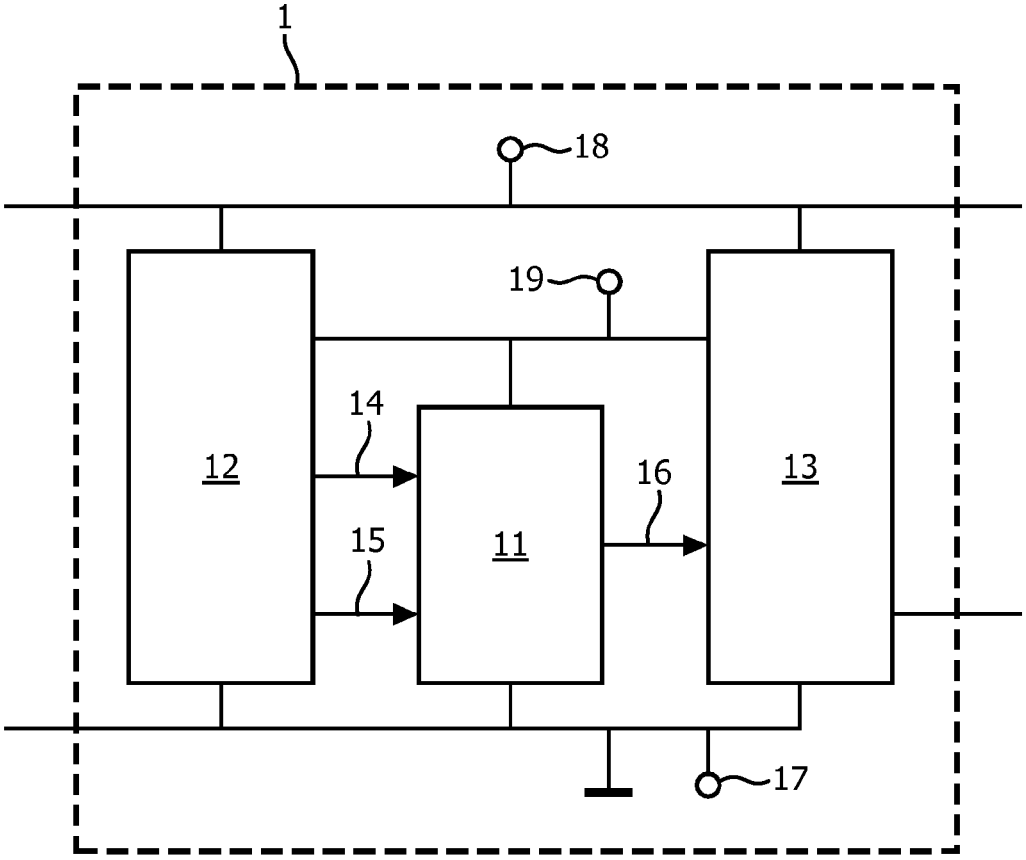
FIG. 2 shows an embodiment of a driver.

In the FIG. 2, an embodiment of a driver 1 is shown. This driver 1 for driving the lamp 2 comprises an arrangement 11 for, in response to detections of instantaneous values of an input voltage signal of the driver 1 and in response to a detection of an average value of the input voltage signal, providing an output current to the lamp 2. The input voltage signal of the driver 1 is the output voltage signal of the rectifying interface 5. The arrangement 11 is for example an AP1682 available in a SOIC-8 package as shown in greater detail in the FIG. 11. The driver 1 further comprises an output interface 13 comprising for example a switch and a transformer as also shown in US 2011/0285301 A1. An input of the output interface 13 is coupled to an output 16 of the arrangement 11.

In a prior art situation, a first input 14 and a second input 15 of the arrangement 11 are coupled via resistor dividers (not shown) to outputs of the rectifying interface 5. The first input 14 receives the detections of the instantaneous values of the input voltage signal of the driver 1, and the second input 15 receives the detection of the average value of the input voltage signal.

This arrangement 11 has a primary side regulation that saves components and reduces costs and has a relatively high power factor and a relatively low total harmonic distortion. Unfortunately, this arrangement 11, like some others, is not dimmer compatible.

To make the driver 1, when comprising the arrangement 11, dimmer compatible, an adaptation circuit 12 is to be introduced. This adaptation circuit 12 adapts at least some of said detections to allow the input voltage signal of the driver 1 to be provided via the dimmer 3 for dimming the lamp 2. Thereto, each detected instantaneous value divided by the detected average value is defined to be a ratio, and at least some of the ratios are to be adapted by the adaptation circuit 12. Preferably, the adaptation circuit 12 adapts the ratios in different ways during different parts of the period of the input voltage signal of the driver 1. Further preferably, the adaptation circuit 12 adapts the ratios such that a time-interval, during which time-interval an input current signal of the driver 1 has instantaneous values larger than a threshold, is increased, as also shown in the FIGS. 6 and 7.

Finally, in the FIG. 2, a first terminal 17 to be coupled to a first reference potential such as ground is shown, a second terminal 18 for receiving the input voltage signal of the driver 1 is shown, and a third terminal 19 to be coupled to a second reference potential such as a supply voltage is shown. Each one of the adaptation circuit 12 and the output interface 13 is coupled to each terminal 17-19, the arrangement 11 is coupled to the terminals 17 and 19.

Figure 3:
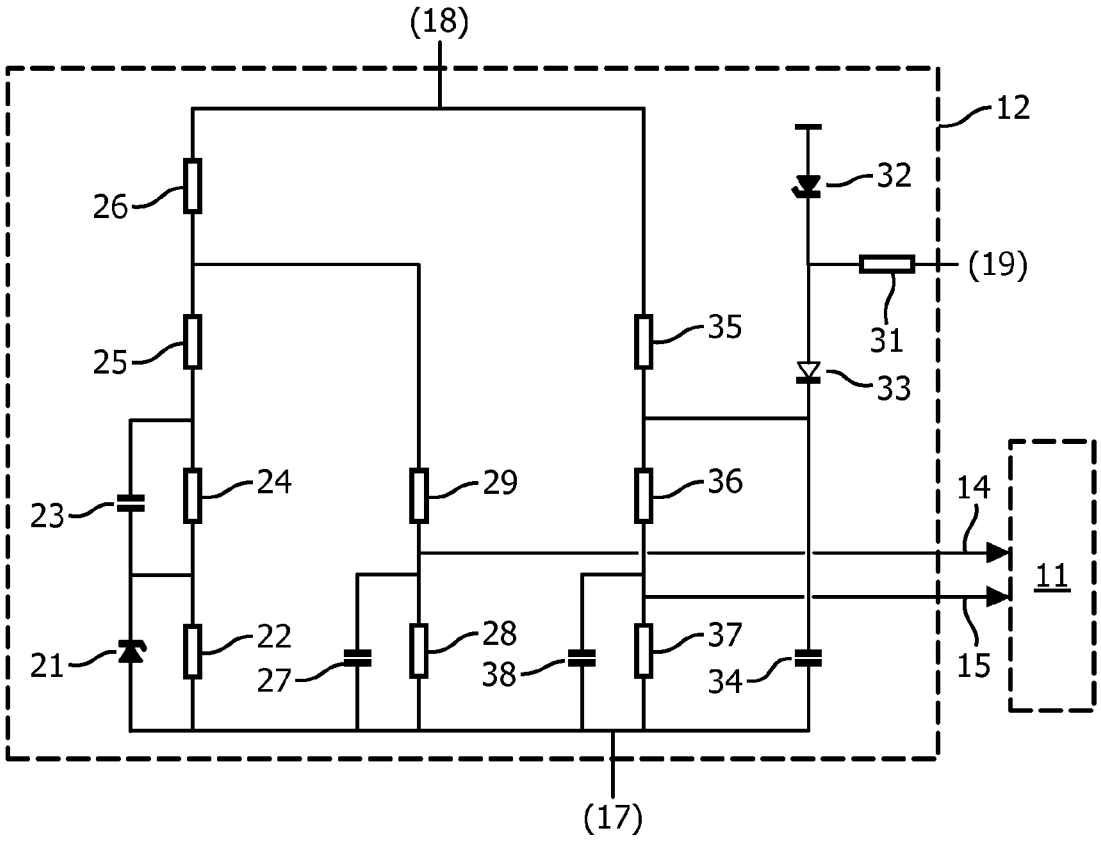
FIG. 3 shows an embodiment of an adaptation circuit.

In the FIG. 3, an embodiment of an adaptation circuit 12 is shown. This embodiment of the adaptation circuit 12 comprises a first circuit 21-29 for adapting the detected instantaneous values of the input voltage signal and a second circuit 31-38 for adapting the detected average value of the input voltage signal. Preferably, the first circuit 21-29 adapts the detected instantaneous values of the input voltage signal in different ways during different parts of the period of the input voltage signal.

The first circuit 21-29 comprises for example an edge shaper 21, 22 for increasing a steepness of first groups of detected instantaneous values of the input voltage signal around 0 degrees and around 180 degrees of the period of the input voltage signal, a delay introducer 23, 24 for introducing a time lag in a second group of detected instantaneous values of the input voltage signal between 1 or more degrees and 179 or fewer degrees of the period of the input voltage signal, and a top shaper for making a third group of detected instantaneous values of the input voltage signal more sinusoidal around 90 degrees of the period of the input voltage signal.

The edge shaper 21, 22 comprises for example a first parallel connection of a first diode 21 and a first resistor 22, the delay introducer 23, 24 comprises for example a second parallel connection of a first capacitor 23 and a second resistor 24, and the top shaper comprises for example a third resistor 25. One side of the first parallel connection is coupled to the first terminal 17 to be coupled to the first reference potential such as ground, and one side of the second parallel connection is coupled to the other side of the first parallel connection. One side of the third resistor 25 is coupled to the other side of the second parallel connection, and one side of a fourth resistor 26 is coupled to the other side of the third resistor 25 and to one side of a fifth resistor 29. The other side of the fourth resistor 26 is coupled to the second terminal 18 for receiving the input voltage signal of the driver 1, and the other side of the fifth resistor 29 is coupled to one side of a third parallel connection of a sixth resistor 28 and a second capacitor 27 and to the first input 14 of the arrangement 11 for providing the adapted detected instantaneous values of the input voltage signal to the arrangement 11. The other side of the third parallel connection is coupled to the first terminal 17. According to this embodiment, the third resistor 25 reduces a total harmonic distortion and improves a power factor.

The second circuit 31-38 comprises for example a limiter 31-33 for limiting a minimum value of the detected average value of the input voltage signal of the driver 1. The limiter 31-33 comprises for example a seventh resistor 31, a second diode 32 and a third diode 33. One side of the seventh resistor 31 is coupled to the third terminal 19 to be coupled to the second reference potential such as for example the supply voltage, and one side of the second diode 32 is coupled to the other side of the seventh resistor 31 and to one side of the third diode 33. The other side of the second diode 32 is coupled to the first terminal 17, and the other side of the third diode 33 is coupled to one side of a third capacitor 34, to one side of an eighth resistor 35 and to one side of a ninth resistor 36. The other side of the eighth resistor 35 is coupled to the second terminal 18, and the other side of the third capacitor 34 is coupled to the first terminal 17. The other side of the ninth resistor 36 is coupled to one side of a fourth parallel connection of a tenth resistor 37 and a fourth capacitor 38 and to the second input 15 of the arrangement 11 for providing the adapted detected peak value of the input voltage signal to the arrangement 11. The other side of the fourth parallel connection is coupled to the first terminal 17. According to this embodiment, the second circuit 31-38 improves how (a light intensity of) the lamp 2 will react to (a conduction angle of) the dimmer 3.

A person skilled in the art will realize that many different embodiments will be possible to build to first and second circuits discussed above.

Figure 4:
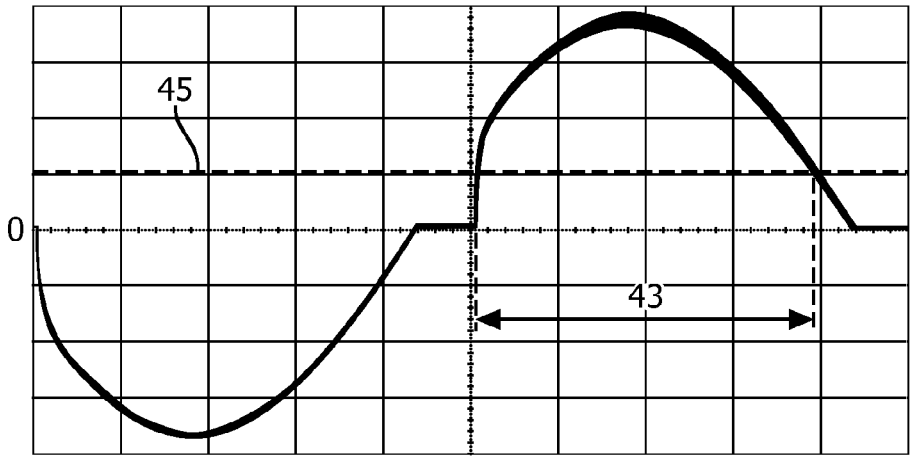
(Prior art) FIG. 4
FIG. 4 shows a prior art waveform of an input current signal.

In the FIG. 4, a prior art waveform of an input current signal of a prior art driver is shown. A time-interval 43 defines the amount of time during which the input current signal of the prior art driver is larger than a threshold value 45 (such as for example the dimmer's holding current threshold).

Figure 5:
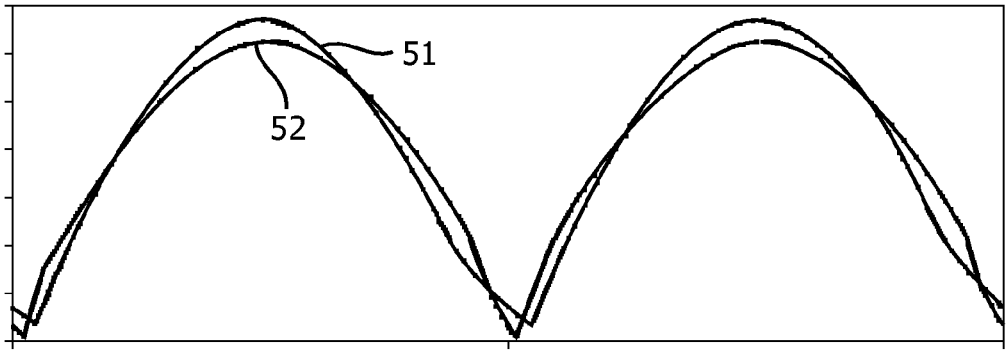
FIG. 5 shows a prior art waveform and an improved waveform of an input voltage signal.

In the FIG. 5, a prior art waveform 51 and an improved waveform 52 of an input voltage signal are shown. The improved waveform 52 is the result of the introduction of the adaptation circuit 12.

Figure 6:
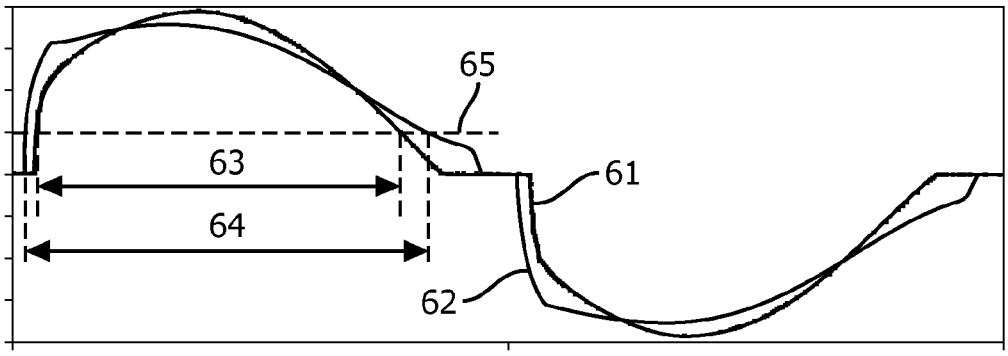
FIG. 6 shows simulated waveforms of input current signals.

In the FIG. 6, simulated waveforms of input current signals are shown. A prior art input current 61 and an improved input current 62 are shown. And a prior art time-interval 63 and an improved time-interval 64 are shown, during which the prior art input current 61 and the improved input current 62 are larger than a threshold 65.

Figure 7:
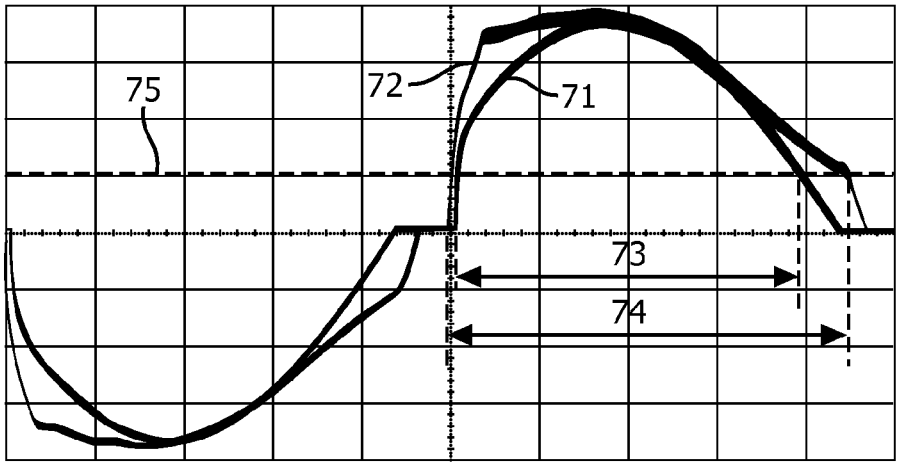
FIG. 7 shows measured waveforms of input current signals.

In the FIG. 7, measured waveforms of input current signals are shown. A prior art input current 71 and an improved input current 72 are shown. And a prior art time-interval 73 and an improved time-interval 74 are shown, during which the prior art input current 71 and the improved input current 72 are larger than a threshold 75.

For both FIGS. 6 and 7, clearly the improved time-intervals 64 and 74 are longer than the prior art time-intervals 63 and 73. At least some dimmers do not like it, when the input current signal of the driver has a relatively low value during a relatively long time interval. The adaptation circuit 12 reduces this problem.

Figure 8:
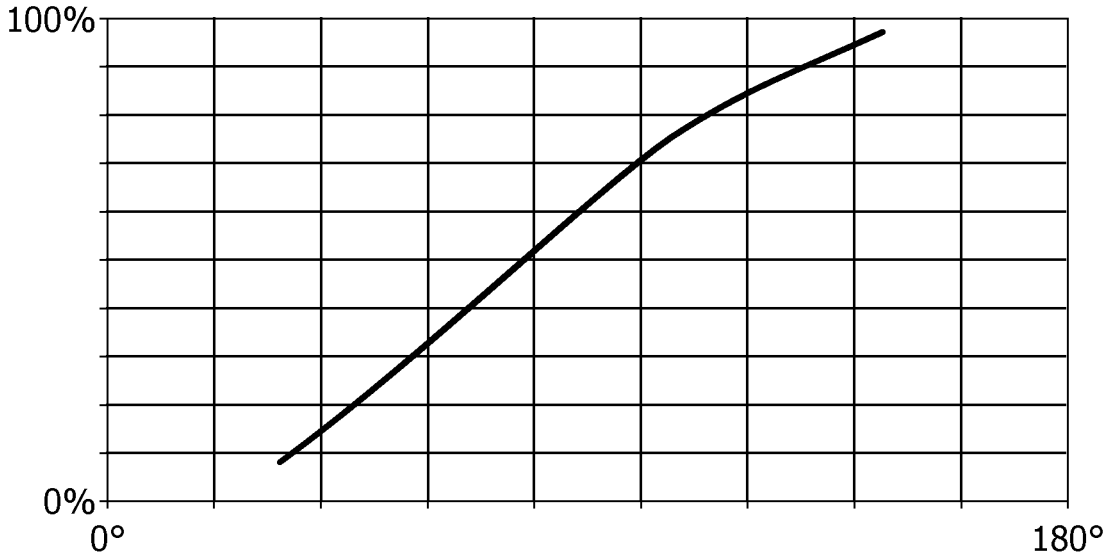
FIG. 8 shows a dimming curve.

In the FIG. 8, a dimming curve is shown. The vertical axis defines a light intensity of the lamp 2, and the horizontal axis defines a conduction angle of the dimmer 3. This conduction angle defines the part of (the half of) the period of the mains voltage signal, during which part the dimmer 3 is conducting.

Figure 9:
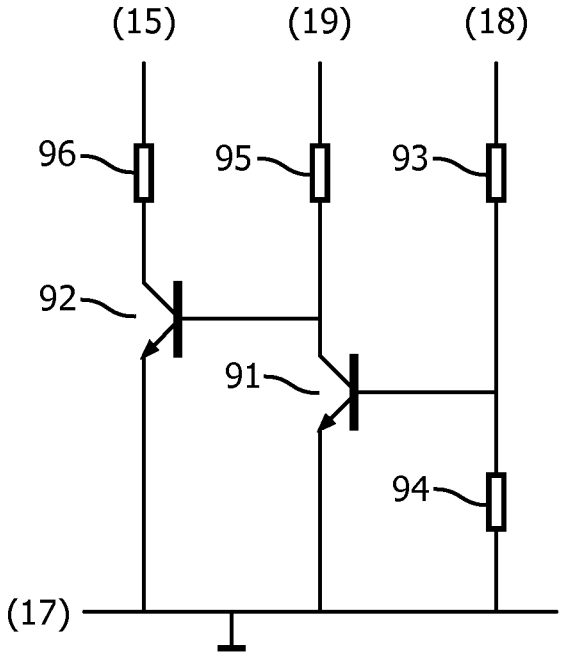
FIG. 9 shows a third circuit for modulating the detected average value of the input voltage signal.

In the FIG. 9, a third circuit 91-96 for modulating the detected average value of the input voltage signal is shown. This third circuit 91-96 introduces a bleeder function and comprises for example first and second transistors 91, 92. One side of an eleventh resistor 93 is coupled to the second terminal 18, and the other side of the eleventh resistor 93 is coupled to a control electrode of the first transistor 91 and via a twelfth resistor 94 to the first terminal 17. A first main electrode of the first transistor 91 is coupled to the first terminal 17, and a second main electrode of the first transistor 91 is coupled to a control electrode of the second transistor 92 and via a thirteenth resistor 95 to the third terminal 19. A first main electrode of the second transistor 92 is coupled to the first terminal 17, and a second main electrode of the second transistor 92 is coupled via a fourteenth resistor 96 to the second input 15 of the arrangement 11 for providing the modulated detected average value of the input voltage signal to the arrangement 11.

Figure 10:
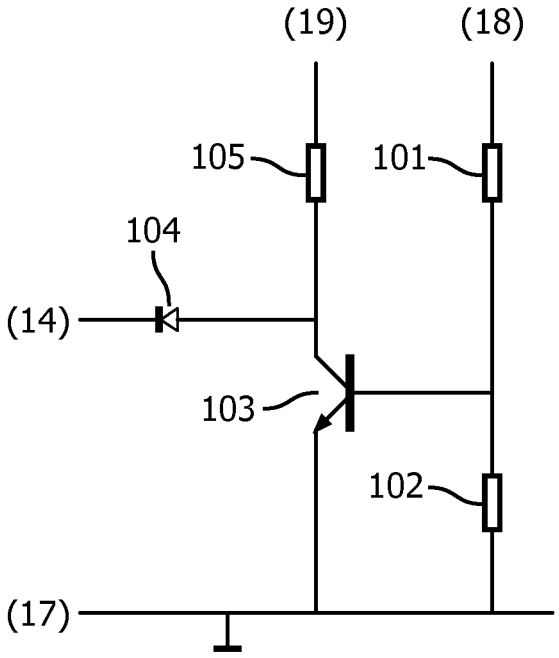
FIG. 10 shows a fourth circuit for modulating the detected instantaneous values of the input voltage signal.

In the FIG. 10, a fourth circuit 101-105 for modulating the detected instantaneous values of the input voltage signal is shown. This fourth circuit 101-105 introduces a bleeder function and comprises for example a third transistor 103 and a fourth diode 104. One side of a fifteenth resistor 101 is coupled to the second terminal 18, and the other side of the fifteenth resistor 101 is coupled to a control electrode of the third transistor 103 and via a sixteenth resistor 102 to the first terminal 17. A first main electrode of the third transistor 103 is coupled to the first terminal 17, and a second main electrode of the third transistor 103 is coupled to one side of the fourth diode 104 and via a seventeenth resistor 105 to the third terminal 19. The other side of the fourth diode 104 is coupled to the first input 14 of the arrangement 11 for providing the modulated detected instantaneous values of the input voltage signal to the arrangement 11.

Figure 11:
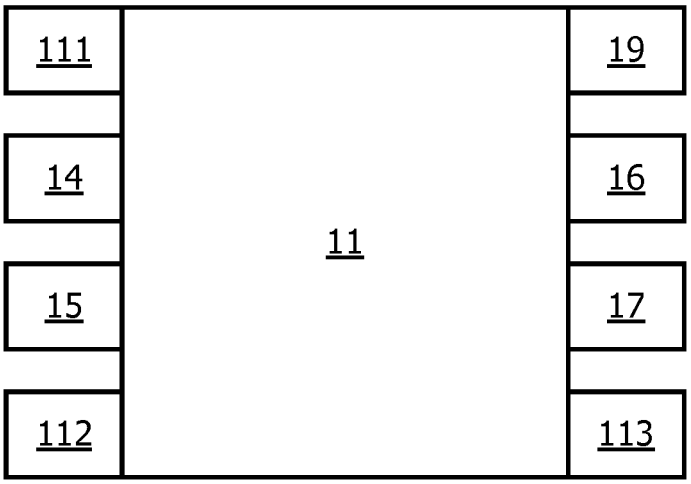
(Prior art) FIG. 11
FIG. 11 shows a prior art arrangement as available on the market.

In the FIG. 11, a prior art arrangement 11 in the form of an AP1682 available in a SOIC-8 package is shown. The pins representing the first and second inputs 14 and 15 and the output 16 have already been discussed above. The pins representing the first and third terminals 17 and 19 have already been discussed above. The pin 111 is a no-connection pin. The pin 112 is a current sensing pin. The pin 113 is a current/voltage feedback pin.

Summarizing, drivers 1 for driving lamps 2 comprising light emitting diodes are provided with arrangements 11 for, in response to detections of instantaneous values and average values of input voltage signals, providing output currents. Detected instantaneous values divided by detected average values form ratios. Adaptation circuits 12 for adapting some ratios make the drivers 1 dimmer compatible. The adaptation circuits 12 may comprise first circuits 21-29 for adapting the detected instantaneous values, second circuits 31-38 for adapting the detected average values, and third circuits 91-96 and fourth circuits 101-105 for respectively modulating the detected average and instantaneous values to add bleeder functions. The adaptation circuits 12 may adapt the ratios in different ways during different parts of a period of the input voltage signal and such that a time-interval, during which time-interval an input current signal of the driver 1 has instantaneous values larger than a threshold, is increased.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A driver for driving a lamp comprising one or more light emitting diodes, the driver comprising an arrangement configured for, in response to detections of instantaneous values of an input voltage signal of the driver and in response to a detection of an average value of the input voltage signal, providing an output current to the lamp, each detected instantaneous value divided by the detected average value forming a ratio, and an adaptation circuit between the input voltage and the arrangement configured for adapting at least some of the ratios to allow the input voltage signal to be provided via a dimmer for dimming the lamp.

2. The driver as defined by claim 1, the adaptation circuit configured for adapting the ratios in different ways during different parts of a period of the input voltage signal.

3. The driver as defined by claim 1, the adaptation circuit configured for adapting the ratios such that a time-interval, during which time-interval an input current signal of the driver has instantaneous values larger than a threshold, is increased.

4. The driver as defined by claim 1, the adaptation circuit comprising a first circuit configured for adapting the detected instantaneous values of the input voltage signal.

5. The driver as defined by claim 4, the first circuit being configured for adapting the detected instantaneous values of the input voltage signal in different ways during different parts of a period of the input voltage signal.

6. The driver as defined by claim 4, the first circuit comprising an edge shaper for increasing a steepness of first groups of detected instantaneous values of the input voltage signal around 0 degrees and around 180 degrees of the period of the input voltage signal, and/or a delay introducer for introducing a time lag in a second group of detected instantaneous values of the input voltage signal between 1 or more degrees and 179 or fewer degrees of the period of the input voltage signal, and/or a top shaper for making a third group of detected instantaneous values of the input voltage signal more sinusoidal around 90 degrees of the period of the input voltage signal.

7. The driver as defined by claim 6, the edge shaper comprising a first parallel connection of a first diode and a first resistor, the delay introducer comprising a second parallel connection of a first capacitor and a second resistor, the top shaper comprising a third resistor, one side of the first parallel connection being coupled to a first terminal to be coupled to a first reference potential, one side of the second parallel connection being coupled to the other side of the first parallel connection, one side of the third resistor being coupled to the other side of the second parallel connection, one side of a fourth resistor being coupled to the other side of the third resistor and to one side of a fifth resistor, the other side of the fourth resistor being coupled to a second terminal for receiving the input voltage signal, the other side of the fifth resistor being coupled to one side of a third parallel connection of a sixth resistor and a second capacitor and to a first input of the arrangement for providing the adapted detected instantaneous values of the input voltage signal to the arrangement, and the other side of the third parallel connection being coupled to the first terminal.

8. The driver as defined by claim 1, the adaptation circuit comprising a second circuit for adapting the detected average value of the input voltage signal.

9. The driver as defined by claim 8, the second circuit comprising a limiter for limiting a minimum value of the detected average value of the input voltage signal.

10. The driver as defined by claim 9, the limiter comprising a seventh resistor, a second diode and a third diode, one side of the seventh resistor being coupled to a third terminal to be coupled to a second reference potential, one side of the second diode being coupled to the other side of the seventh resistor and to one side of the third diode, the other side of the second diode being coupled to a first terminal to be coupled to a first reference potential, the other side of the third diode being coupled to one side of a third capacitor, to one side of an eighth resistor and to one side of a ninth resistor, the other side of the eighth resistor being coupled to a second terminal for receiving the input voltage signal, the other side of the third capacitor being coupled to the first terminal, the other side of the ninth resistor being coupled to one side of a fourth parallel connection of a tenth resistor and a fourth capacitor and to a second input of the arrangement for providing the adapted detected average value of the input voltage signal to the arrangement, the other side of the fourth parallel connection being coupled to the first terminal.

11. The driver as defined by claim 1, the adaptation circuit comprising a third circuit for modulating the detected average value of the input voltage signal.

12. The driver as defined by claim 11, the third circuit comprising first and second transistors, one side of an eleventh resistor being coupled to a second terminal for receiving the input voltage signal, the other side of the eleventh resistor being coupled to a control electrode of the first transistor and via a twelfth resistor to a first terminal to be coupled to a first reference potential, a first main electrode of the first transistor being coupled to the first terminal, a second main electrode of the first transistor being coupled to a control electrode of the second transistor and via a thirteenth resistor to a third terminal to be coupled to a second reference potential, a first main electrode of the second transistor being coupled to the first terminal, and a second main electrode of the second transistor being coupled via a fourteenth resistor to a second input of the arrangement for providing the modulated detected average value of the input voltage signal to the arrangement.

13. The driver as defined by claim 1, the adaptation circuit comprising a fourth circuit for modulating the detected instantaneous values of the input voltage signal.

14. The driver as defined by claim 13, the fourth circuit comprising a third transistor and a fourth diode, one side of a fifteenth resistor being coupled to a second terminal for receiving the input voltage signal, the other side of the fifteenth resistor being coupled to a control electrode of the third transistor and via a sixteenth resistor to a first terminal to be coupled to a first reference potential, a first main electrode of the third transistor being coupled to the first terminal, a second main electrode of the third transistor being coupled to one side of the fourth diode (104) and via a seventeenth resistor to a third terminal to be coupled to a second reference potential, the other side of the fourth diode being coupled to a first input of the arrangement for providing the modulated detected instantaneous values of the input voltage signal to the arrangement.

15. A device comprising the driver as defined in claim 1 and further comprising the lamp and/or the dimmer.

* * * * *